United States Patent [19]

Korbelak et al.

[11] 4,075,065

[45] Feb. 21, 1978

[54] GOLD PLATING BATH AND PROCESS

[75] Inventors: Alexander Korbelak, Southbury, Conn.; John King, Anaheim, Calif.

[73] Assignee: Handy & Harman, New York, N.Y.

[21] Appl. No.: 697,687

[22] Filed: June 18, 1976

Related U.S. Application Data

[63] Continuation-in-part of Ser. No. 593,423, July 7, 1975, abandoned, which is a continuation-in-part of Ser. No. 375,616, July 2, 1973, Pat. No. 3,893,896.

[51] Int. Cl.[2] ..... C25D 3/62

[52] U.S. Cl. ..... 204/43 G; 204/44

[58] Field of Search ..... 204/43 G, 44, 46 G, 204/109, 123; 106/1

[56] References Cited

U.S. PATENT DOCUMENTS

| | | | |
|---|---|---|---|
| 3,423,295 | 1/1969 | Greenspan | 204/43 G |

FOREIGN PATENT DOCUMENTS

| | | | |
|---|---|---|---|
| 1,331,064 | 5/1963 | France | 204/46 G |
| 928,088 | 6/1963 | United Kingdom | 204/46 G |
| 931,638 | 7/1963 | United Kingdom | 204/46 G |

*Primary Examiner*—G. L. Kaplan

*Attorney, Agent, or Firm*—Brumbaugh, Graves, Donohue & Raymond

[57] ABSTRACT

An electrolyte for depositing gold on a surface includes an alkali gold cyanide, a weak Lewis acid, a weak polyfunctional water-soluble aliphatic acid, a non-depositing metallic compound, a metallic hardener, and water.

4 Claims, No Drawings

GOLD PLATING BATH AND PROCESS

CROSS REFERENCE TO RELATED APPLICATION

This is a continuation-in-part of application Ser. No. 593,423, filed July 7, 1975, now abandoned, which in turn is a continuation-in-part of application Ser. No. 375,616, filed July 2, 1973, now U.S. Pat. No. 3,893,896, issuued July 8, 1975.

BACKGROUND OF THE INVENTION

It is known to employ electrolytes for the deposition of gold electrodeposits, U.S. Pat. Nos. 2,967,135, 2,905,601, 3,149,057 3,303,112 and 3,598,706, which are incorporated herein by reference. Frequently, hardeners such as cobalt, nickel, silver and copper are codeposited with the gold.

There have been several disadvantages with the plating solutions used in the past. Firstly, the content of the codeposit hardener is erratic. This means that the plated surfaces have different abrasion and wear characteristics from batch to batch. Secondly, the previously used electrolytes have poor throwing power when there is an acceptable cathode deposition rate, i.e., 30 mg/amp min or more. This results in more gold being used than the theoretical amount required to obtain a minimum thickness of gold on the most shielded part of the cathodic surface.

SUMMARY OF THE INVENTION

It has now been discovered that the aforementioned disadvantages can be alleviated by using a new plating solution. Thus, in accordance with this invention, a solution is formed from (1) an alkali cyanide, (2) a weak or soft Lewis acid, (3) a weak polyfunctional water-soluble aliphatic acid, (4) a non-depositing metallic compound, (5) a metallic hardener, and (6) water. This solution is employed as an electrolyte for plating a hard, bright gold electrodeposit whose hardener content is much more uniform even when the deposit is produced under a wider range of operating conditions. Additionally, the uniformity of metal distribution, i.e., throwing power, is greatly improved, allowing for the deposition of less gold to obtain minimum thicknesses over irregularly shaped cathodes.

DESCRIPTION OF THE INVENTION

The first component in the plating solution is a soluble, alkali gold cyanide in an amount ranging from about 0.1 to 50 grams per liter, preferably about 5 to 15 grams per liter. The following compounds, among others, are suitable: potassium gold cyanide, sodium gold cyanide, ammonium gold cyanide and mixtures thereof. The preferred compound is potassium gold cyanide.

The second component is a weak or soft Lewis acid which acts not as a proton donor but as an acceptor of $OH^-$ ions. The weak or soft Lewis acids are different from the strong or hard Lewis acids since the acceptor atom of the former has the following properties: Low or zero positive charge, large size, and several easily excited outer electrons. A hard acid is distinguished by small size, high positive oxidation state and the absence of any outer electrons which are easily excited to higher states.

Advantageously, the weak Lewis acid is monobasic. When it is combined with other components, an effective buffering system is formed having a pH between about 3.7 and 4.8, preferably between about 4.0 and 4.5.

The following, among others, are suitable weak Lewis acids: a quinone such as quinaldic acid and 8-quinolinboronic acid; boric acid; phthalic acid; potassium acid phthalates; water-soluble salts of zirconiuum and vanadium, e.g., zirconium oxychloride, vanadyl sulphate, zirconium oxysulfate, zirconium selenate, zirconium oxyiodide, zirconium oxybromide, vanadium iodide, vanadium triodide, vanadium oxydibromide and vanadium oxytribromide; hypophosphorous acid; orthophosphorpus acid and mixtures thereof. The amount of the weak Lewis acid ranges from about 5 to 250 grams per liter, preferably about 5 to 40 grams per liter. Other suitable weak Lewis acids are described in *Theoretical Inorganic Chemistry,* M. D. Day, Jr. and J. Selbin, 2nd Edition, p. 370, Van Nostrand-Reinhold (1969), which is incorporated here by reference.

A third component in the plating solution is at least one polyfunctional, water-soluble, weak, stable aliphatic acid containing one or more carboxylic acid or hydroxy groups. The preferred compounds have 2 to 8 carbons. Suitable acids, among others, are as follows: itaconic, citraconic, gluconic, glutaric, glycolic, citric, kojic, malic, succinic, lactic, tartaric and mixtures thereof. This component is used in amounts ranging from about 5 to 500 grams per liter, preferably about 40 to 150 grams per liter.

The plating solution has a fourth component which is a compound of a reactive, non-depositing metal. This compound must be soluble in the acid solution. The preferred metals have an electrode potential above $\pm 1.5$ volts and are capable of forming chelates with the weak organic acid. The metal, among others, may be aluminum, barium, beryllium, magnesium, rubidium, lithium, strontium and mixtures thereof. The compound, among others, may be an oxide, a carbonate, an acetate, a citrate, a borate, a sulfate and mixtures thereof. This component is used in the range of about 5.0 to 250 grams per liter, preferably about 15 to 100 grams per liter.

A fifth component is a hardener which is a water-soluble, transition metal salt. The following metals, among others, are applicable: cobalt, nickel, cadmium, silver, copper, iron, platinum, indium, manganese, osmium, ruthenium, antimony, lead, zinc and mixtures thereof. The salt may be one of the following, among other: sulfates, sulfamates, chlorides, formates acetates, citrates, glycolates, tartrates, fluoborates, borates, phosphates, itaconates, malates, gluconates oxalates, and mixtures thereof. All of the aforementioned metals form at least one component from the aforementioned salts. The amount of hardener in the plating solution is usually about 0.01 to 15 grams per liter of metal ion, preferably about 0.02 to 0.10 grams per liter.

The sixth component is water in an amount sufficient to produce an electrolyte of one liter with ingredient concentration ranges described above.

The bath of this invention can also have certain optional ingredients varying over wide ranges. This includes the following, among others: glycine in an amount from about 5 to 20 grams per liter, to produce lower karat deposits; hexasodium salt of triethylene tetramine hexaacetic acid in an amount from about 0.25 to 20 grams per liter is used to solubilize otherwise insoluble metal compounds; and sodium alpha glucoheptonate dihydrate in an amount from about 0.25 to 30 grams per liter is used for the prevention of the codeposition of undersirable metallic impurities, such as tin, lead and iron, which are common contaminants in gold baths especially those used for soldered components.

The following mixture produces a yellow gold deposit that is 99.85% gold and 0.15% nickel:

| | |
|---|---|
| Potassium gold cyanide | 8.0 g/l |
| Boric acid | 18.0 g/l |
| Magnesium oxide | 18.0 g/l |
| Citric acid | 90.0 g/l |
| pH | 4.5 electrometric |
| Nickel citrate | 0.200 g/l |

When 15 g/l glycine are added to the solution a white gold deposit, 79.37% gold and 20.15% nickel, is produced.

The aforementioned six components and any optional components may be combined in any suitable manner to form a plating solution. Each component may be added separately or several components may be pre-mixed before they are included in the plating solution. The components can be replenished during plating to maintain the proper concentrations.

The electrolytic deposition can be conducted with insoluble anodes, such as platinum, gold, stainless steel or carbon. The cathode is the article (ware) which is being plated and it may be copper, brass and other copper alloys, nickel, steel, Kovar, or any other properly prepared material. The ratio of the anode surface area to cathode surface area is from about 4.1 to 10.1.

The electric tension between the anodes and the ware is frequently held within the range of about 3 to 9 volts. The pH of the bath ranges generally from about 3.7 to 4.8. The temperature of the bath during the electrodeposition is usually between about 90° to 120° F. Mechanical agitation of the bath, such as with a stirrer, may be used to improve the operation. The current of the bath can vary from about 0.5 to 20 amperes per square foot of cathode. The plating rates can be about 30 to 90 milligrams per ampere-minute (123 mg/amp min = 100% cathode efficiency).

Thus, in accordance with the invention, a gold deposit is effected in a range from about 24 to 18 karats. The color of the deposit is yellow to pink to white, but preferably is yellow. The thickness of the gold deposit can be between 0.1 and 100 microns. Moreover, the gold is plated from the bath with excellent throwing power and with excellent hardener stability; accordingly, there is less variation in thickness, in gold deposited on pieces with complex geometries thus permitting plating economies, i.e., by avoiding excess plate incidental to depositing the minimum on shielded parts. There also is a more uniform hardener content in the deposit, permitting more uniform deposit characteristics, i.e., electrical resistivities, wear and abrasion resistivities.

In the present invention, the throwing power is above 55% when the cathode deposition rate is at least 30 mg/amp min. This is determined by the Blum and Haring Formula.

$$\text{Throwing Power} = \frac{100 \times (K - M)}{K}$$

wherein K is the primary current distribution ratio (in all cases discussed here K = 4) and M is the weight distribution ratio. Maximum throwing power under this formula is 75%.

The hardener stability is measured by the maximum variance in the hardener content in the deposit as operating conditions are varied. The maximum variance in calculated s follows:

Maximum Variance = Largest conteent % − Smallest content %. This invention provides an average maximum variance of 0.06 (usually 0.07 to 0.05%) when the temperature is varied from 80° to 120° F, whereas previous baths have an average maximum variance of 0.18% (usually 0.27% to 0.13%) when this temperature is varied from 80° to 120° F. This invention also provides for an average maximum variance of 0.07 (usually 0.08 to 0.04%) when the cathode current density is varied from 5 to 20 A.S.F., while common commercial baths have an average maximum variance of 0.22% (usually 0.15 to 0.31%) when the cathode current density is varied from 5 to 20 A.S.F.

The following examples are submitted to illustrate, but not limit this invention. Unless otherwise indicated, all parts and percentages in the specification and calims are based upon weight.

EXAMPLE I

Plating solutions A, B, C and D were prepared from the compounds listed in Table I.

TABLE I

| Compounds | Solutions (grams per liter) A | B | C | D |
|---|---|---|---|---|
| Potassium Gold Cyanide | 12 | 12 | 12 | 12 |
| Boric Acid | 18 | 36 | — | 18 |
| Potassium Acid Phthalate | — | — | 8 | — |
| Citric Acid | 90 | 90 | 90 | — |
| Malic Acid | — | — | — | 110 |
| Magnesium Oxide | 18 | — | 18 | — |
| Lithium Carbonate | — | 55 | — | — |
| Aluminum Carbonate | — | — | — | 55 |
| Cobalt Citrate | 0.02 | 0.04 | 0.04 | 0.04 |
| Water[a] | | | | |
| Throwing Power (%)[b] | 60% | 70% | 65% | 57% |
| Hardener Stability[c] | .06 | .07 | .05 | .07 |

[a]To make one liter.
[b]When cathode deposition rate is 30 mg/amp min.
[c]Measured by maximum variance.

Each compound was added separately to the vessel which was glass. The anode was platinum and the cathode was brass. The pH of the solution was 4.0, and it was stirred during the plating. The current at the cathode was 10 amperes per square foot with a plating rate of 50 milligrams per ampere-minute.

The gold deposited on each sample was 24 karats, and the color of each was yellow. The thickness of each gold deposit was 5 microns. Further results are indicated in Table I.

This example shows that the plating solutions of the invention have condeposited hardener stability and high throwing power at acceptable plating rates.

EXAMPLE II

By repeating the procedure of Example I, it is considered that suitable plating solutions can be prepared by mixing compounds as indicated herebelow:

| Compounds | Solution E Grams per liter |
|---|---|
| Sodium Gold Cyanide | 10 |
| Boric Acid | 18 |
| Magnesium Oxide | 18 |
| Citric Acid | 60 |
| Rhodium Sulfate | 0.2 |

-continued

| Solution E | |
|---|---|
| Compounds | Grams per liter |
| Water to make one liter | |

| Solution F | |
|---|---|
| Compounds | Grams per liter |
| Potassium Gold Cyanide | 12 |
| Glycolic Acid | 90 |
| Boric Acid | 18 |
| Barium Sulfate | 24 |
| Nickel Sulfamate | 0.2 |
| Water to make one liter | |

| Solution G | |
|---|---|
| Compounds | Grams per liter |
| Potassium Gold Cyanide | 12 |
| Boric Acid | 24 |
| Succinic Acid | 90 |
| Beryllium Oxide | 40 |
| Palladium Chloride | 0.7 |
| Water to make one liter | |

| Solution H | |
|---|---|
| Compounds | Grams per liter |
| Potassium Gold Cyanide | 12 |
| Lactic Acid | 90 |
| Magnesium Citrate | 30 |
| Boric Acid | 24 |
| Copper Fluoborate | 0.6 |
| Water to make one liter | |

| Solution I | |
|---|---|
| Compounds | Grams per liter |
| Potassium Gold Cyanide | 12 |
| Phthalic Acid | 12 |
| Rubidium Citrate | 20 |
| Indium Chloride | 0.9 |
| Water to make one liter | |
| Citric Acid | 90 |

| Solution J | |
|---|---|
| Compounds | Grams per liter |
| Potassium Gold Cyanide | 12 |
| Boric Acid | 90 |
| Lithium Carbonate | 50 |
| Itaconic Acid | 90 |
| Ferric Sulfate | 1.1 |

-continued

| Solution J | |
|---|---|
| Compounds | Grams per liter |
| Water to make one liter | |

| Solution K | |
|---|---|
| Compounds | Grams per liter |
| Potassium Gold Cyanide | 12 |
| Boric Acid | 30 |
| Magnesium Oxide | 18 |
| Glycine | 20 |
| Nickel Glycolate | 1.2 |
| Water to make one liter | |
| Kojic Acid | 90 |

| Solution L | |
|---|---|
| Compounds | Grams per liter |
| Potassium Gold Cyanide | 8 |
| Boric Acid | 18 |
| Magnesium Citrate | 18 |
| Kojic Acid | 90 |
| Nickel Tartrate | 0.5 |
| Water to make one liter | |

| Solution M | |
|---|---|
| Compounds | Grams per liter |
| Potassium Gold Cyanide | 8 |
| Boric Acid | 18 |
| Strontium Carbonate | 18 |
| Kojic Acid | 90 |
| Rhodium Phosphate | 0.5 |
| Water to make one liter | |

EXAMPLE III

By repeating the procedure of Example I, plating solutions were prepared by mixing the compounds indicated in Table II.

TABLE II

| | Solutions (grams per liter) | | | |
|---|---|---|---|---|
| Compounds | N | O | P | Q |
| Potassium Gold Cyanide | 12 | 12 | 12 | 12 |
| Citric Acid | 90 | 90 | 90 | 90 |
| Magnesium Oxide | 18 | 18 | 18 | 18 |
| Cobalt Citrate | 0.02 | 0.02 | 0.02 | 0.02 |
| Zirconium Sulphate | 27 | — | — | — |
| Zirconium Oxychloride | — | 27 | — | — |
| Vanadyl Sulphate | — | — | 27 | — |
| Hypophosphorous Acid | — | — | — | 27 |
| Boric Acid | — | — | — | 9 |
| Water (a) | | | | |
| Throwing Power (%) | 59.5 | 58.7 | 56.6 | 56.25 |
| Cathode Deposition Rate (b) | 34.3 | 75 | 69 | 47.5 |

(a) To make one liter
(b) mg/amp min.

The data in this example demonstrate that the plating solutions of the invention have high throwing power at acceptable plating rate. Based on a sampling of the results, the plating solutions of the invention have codeposited hardener stability.

Having set forth the general nature and specific embodiments of the present invention, the true scope is now particularly pointed out in the appended claims.

We claim:

1. An acidic electrolytic bath for electrodeposition of gold comprising:

a. an alkali gold cyanide in an amount ranging from 0.1 to 50 grams per liter;

b. zirconium oxychloride in an amount ranging from 5 to 250 grams per liter;
c. a weak polyfunctional water-soluble aliphatic carboxylic acid in an amount ranging from 5 to 500 grams per liter;
d. a non-depositing metallic compound in an amount ranging from 5 to 250 grams per liter;
e. a metallic hardener in an amount ranging from 0.01 to 15 grams of metal ion per liter; and
f. water.

2. An acidic electrolytic bath for electrodeposition of gold comprising:
a. an alkali gold cyanide in an amount ranging from 0.1 to 50 grams per liter;
b. vanadyl sulphate in an amount ranging from 5 to 250 grams per liter;
c. a weak polyfunctional water-soluble aliphatic carboxylic acid in an amount ranging from 5 to 500 grams per liter;
d. a non-depositing metallic compound in an amount ranging from 5 to 250 grams per liter;
e. a metallic hardener in an amount ranging from 0.01 to 15 grams of metal ion per liter; and
f. water.

3. A process for electrodeposition of gold on the surface of a conductive article which comprises:
a. immersing the article in an acidic electrolytic bath containing
1. an alkali gold cyanide in an amount ranging from 0.1 to 50 grams per liter,
2. zirconium oxychloride in an amount ranging from 5 to 250 grams per liter,
3. a weak polyfunctional water-soluble aliphatic carboxylic acid in an amount ranging from 5 to 500 grams per liter,
4. a non-depositing metallic compound in an amount ranging from 5 to 250 grams per liter,
5. a metallic hardener in an amount ranging from 0.01 to 15 grams of metal ion per liter, and
6. water; and
b. passing an electric current between an anode and said conductive article as a cathode.

4. A process for electrodeposition of gold on the surface of a conductive article which comprises:
a. immersing the article in an acidic electrolytic bath containing
1. an alkali gold cyanide in an amount ranging from 0.1 to 50 grams per liter,
2. vanadyl sulphate in an amount ranging from 5 to 250 grams per liter,
3. a weak polyfunctional water-soluble aliphatic carboxylic acid in an amount ranging from 5 to 500 grams per liter,
4. a non-depositing metallic compound in an amount ranging from 5 to 250 grams per liter,
5. a metallic hardener in an amount ranging from 0.01 to 15 grams of metal ion per liter, and
6. water; and
b. passing an electric current between an anode and said conductive article as a cathode.

* * * * *

UNITED STATES PATENT OFFICE

CERTIFICATE OF CORRECTION

Patent No. 4,075,065 Dated February 21, 1978

Inventor(s) Korbelak et al.

It is certified that error appears in the above-identified patent and that said Letters Patent are hereby corrected as shown below:

Col. 1, line 10, "issuued" should be --issued--;
Col. 1, line 21, "codeposit" should be --codeposited--;
Col. 1, line 61, "Low" should be --low--;
Col. 2, line 6, "phthalates" should be --phthalate--, and "zirconiuum" should be --zirconium--;
Col. 2, lines 11 and 12, "orthophosphorpus" should be --orthophosphorous--;
Col. 2, line 33, "±1.5" should be --+1.5--;
Col. 2, line 45, after "platinum," insert --palladium,--;
Col. 2, line 47, "other" should be --others--;
Col. 2, line 48, after "formates" insert a comma;
Col. 3, line 1, "undersirable" should be --undesirable--;
Col. 4, lines 3 & 4, "in calculated s" should be --is calculated as--;
Col. 4, line 5, "conteent" should be --content--;
Col. 4, line 21, "calims" should be --claims--; and
Col. 4, line 54, "condeposited" should be --codeposited--.

Signed and Sealed this

Eighth Day of August 1978

[SEAL]

Attest:

RUTH C. MASON
Attesting Officer

DONALD W. BANNER
Commissioner of Patents and Trademarks